United States Patent [19]

Grubbs

[11] 4,171,702

[45] Oct. 23, 1979

[54] POLY (ISOPROPENYL ESTERS) AS CARBOXYLIC ACID-RELEASE AGENTS ON TOBACCO

[75] Inventor: Harvey J. Grubbs, Mechanicsville, Va.

[73] Assignee: Philip Morris Incorporated, New York, N.Y.

[21] Appl. No.: 868,562

[22] Filed: Jan. 10, 1978

[51] Int. Cl.[2] ..... A24B 15/04; A24B 15/05

[52] U.S. Cl. ..... 131/17 R; 131/144; 426/534; 131/2; 131/17 A; 131/140 C

[58] Field of Search ..... 131/17 R–17 AE, 131/144, 2; 426/534, 538

[56] References Cited

U.S. PATENT DOCUMENTS

| | | | |
|---|---|---|---|
| 2,646,437 | 7/1953 | Dickey et al. | 260/410.9 |
| 2,766,145 | 10/1956 | Jones | 131/17 |
| 2,766,147 | 10/1956 | Rowland | 131/17 |
| 2,766,148 | 10/1956 | Rowland | 131/17 |
| 2,766,149 | 10/1956 | Rowland | 131/17 |
| 4,092,988 | 6/1978 | Van Auken et al. | 131/17 |
| 4,119,106 | 10/1978 | Grubbs et al. | 131/17 |

OTHER PUBLICATIONS

"Reactions of Isopropenyl Acetate," *Ind. and Eng. Chem.,* vol. 41, #12, pp. 2920–2924, 1949, Hagemeyer et al.

"Acid Catalyzed Interchange Reactions of Carboxylic Acids with Enol Esters," *J. Organic Chem.,* Rothman et al., vol. 27, pp. 3123–3127, 1962.

*Primary Examiner*—Robert W. Michell
*Assistant Examiner*—Thomas J. Wallen
*Attorney, Agent, or Firm*—Arthur I. Palmer; Susan A. Hutcheson; George E. Inskeep

[57] ABSTRACT

This invention provides carboxylic acid flavorant-release oligomeric and polymeric derivatives corresponding to the structural formula:

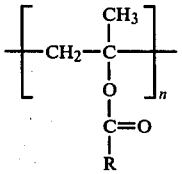

wherein R is a member selected from aliphatic, alicyclic, and aromatic hydrocarbon radicals and n is an integer. The oligomeric and polymeric derivatives are stable when used in smoking products and on pyrolysis release the carboxylic acid flavorants to enhance the flavor and aroma of the smoke.

13 Claims, No Drawings

POLY (ISOPROPENYL ESTERS) AS CARBOXYLIC ACID-RELEASE AGENTS ON TOBACCO

BACKGROUND OF THE INVENTION

The incorporation of flavorants in tobacco products is an important development in the tobacco industry due to the lowered aromaticity of the available tobacco and the increased preference of smokers for filter cigarettes and low delivery cigarettes. The addition of certain desirable flavorants to tobacco is limited by their volatility, which causes them to be lost or diminished in quantity during processing and storage of the tobacco product. This problem is even more acute for filter cigarettes containing an active adsorbent, such as charcoal, in the filters. During the processing and storage of this type of product, volatile flavorants have a tendency to migrate from the tobacco and may be irreversibly bound by the active adsorbent thereby partially or completely depleting the flavorant in the product and possibly altering the effectiveness of the acute adsorbent in its selective removal of undesirable smoke components.

The use of carboxylic acid flavorants for tobacco products has received acceptance because of the desirable aroma and flavor characteristics which they impart to the smoke (J. C. Leffingwell, H. J. Young, and E. Bernasek, "Tobacco Flavoring for Smoking Products," R. J. Reynolds Tobacco Company, Winston-Salem, 1972). Specifically, acetic acid is commonly used as an ingredient of a Latakia tobacco flavoring formulation (J. Merory, "Food Flavorings," AVI Publishing Company, Incorporated, Westport, Connecticut, page 420, 1968). Isovaleric acid and 3-methylvaleric acid are major ingredients in a Turkish tobacco flavor formulation (R. H. Stedman and C. D. Stills, U.S. Pat. No. 3,180,340). Desirable flavors have been imparted to cigarette smoke by the addition of 4-ketoacids to tobacco (W. A. Rohde, U.S. Pat. No. 3,313,307).

Numerous methods of adding flavorants to tobacco smoke are known. However, none of the known methods has been found to be completely satisfactory, particularly when the flavorant is a low molecular weight carboxylic acid. Specifically, some of these acids are highly volatile and possess objectionably strong odors that render them difficult to use in bulk amounts required for manufacturing purposes. In addition, some of the volatile acids may impart an undesirable pack aroma.

In an attempt to alleviate some of these problems, carboxylic acids have been incorporated in tobacco as part of a compound (i.e., an organic acid release agent) in such form that upon burning of the tobacco the compound will liberate one or more organic acids imparting a selected and desired flavor and aroma to the smoke. While considerably more satisfactory then earlier attempts, even this technique has evidenced certain drawbacks.

For example, U.S. Pat. Nos. 2,766,145 through 2,766,150 describe a variety of methods for treating tobacco with compounds that release carboxylic acids on pyrolysis. The 2,766,146 patent describes esters of polyhydroxy compounds as additives for tobacco; however, these esters are still sufficiently volatile to distill down a cigarette rod before appreciable pyrolysis and release of the desired carboxylic acid occurs.

U.S. Pat. No. 2,766,150 describes nonvolatile synthetic polymers or condensation products, preferably those related to polyvinyl alcohol and vinyl alcohol-type condensation products. On pyrolysis, the carboxylic acid is liberated to flavor the smoke. These polymers have a distinct disadvantage in that they generally have high molecular weights and are more difficult to solubilize for application on tobacco.

Flavor release technology with respect to menthol has received much attention in recent years, and various approaches have been suggested in an attempt to solve the problem of retaining menthol in tobacco and achieving an even and quantitative delivery of menthol in the smoke.

U.S. Pat. Nos. 3,886,603 and 4,002,179 describe the development of a new type of menthol-release agent for imparting menthol flavor to tobacco smoke. The menthol-release agent is a polymeric l-menthyl carbonate ester composition characterized by the presence of a tertiary alcohol ester attachment. Other types of polymeric flavorant release resins, which have been described recently, are prepared by the polymerization of an $\alpha$-substituted-vinyl carbonate ester and are specifically designed to release alcohol flavorants on pyrolysis.

Many of the flavorant-release methods mentioned hereinabove suffer certain disadvantages, such as premature release of the flavorant, low transfer to mainstream smoke, and, in some instances, undesirable off-taste or flavor in the tobacco smoke.

Accordingly, it is a main object of this invention to provide a tobacco flavorant that is characterized by lack of mobility and/or volatility at ambient temperature when incorporated in a tobacco composition.

It is another object of this invention to provide a polymeric composition that is adapted to release carboxylic acid flavorant of enhancing character to tobacco smoke under normal smoking conditions with optimal efficiency and without masking of the natural flavor of the resultant main stream tobacco smoke.

It is a further object of this invention to provide a polymeric composition that is adapted to release carboxylic acids to tobacco smoke under normal smoking conditions with nondeleterious effect on the flavor of the resultant tobacco smoke.

It is yet a further object of this invention to provide polymeric compositions that are stable under normal manufacturing processes and that will not impart an undesirable aroma to the tobacco or to a pack of cigarettes.

Other objects and advantages of the present invention shall become apparent from the following description and examples.

DESCRIPTION OF THE INVENTION

One or more objects of the present invention are accomplished by the provision of a carboxylic acid flavorant-release poly(isopropenyl ester) composition having a molecular weight in the range between about 200 and 20,000 and consisting essentially of recurring monomer units corresponding to the formula:

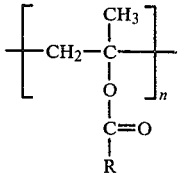

wherein R is a member selected from the group consisting of aliphatic, alicyclic, and aromatic hydrocarbon radicals containing between 1 and about 10 carbon atoms and n is an integer between 2 and about 200.

In the poly(isopropenyl ester) formula hereinabove, R is preferably a saturated straight or branched aliphatic radical containing between 1 and about 6 carbon atoms, such as methyl, ethyl, propyl, isopropyl, butyl, isobutyl, pentyl, isopentyl, and the like. Preferred alicyclic R radicals are those containing between about 3 and 10 carbon atoms, such as cyclopropyl, cyclobutyl, cyclopentyl, cyclohexyl, and the like, and alkyl-substituted derivatives thereof. Preferred aromatic R radicals are those containing between 6 and 10 carbon atoms, such as phenyl, tolyl, xylyl, and the like, and phenylalkyl radicals, such as benzyl, phenylethyl, phenylpropyl, and the like.

Preparation of Poly(Isopropenyl Ester) Compositions

The low molecular weight oligomeric and polymeric carboxylic acid flavorant-release poly(isopropenyl ester) compositions of the present invention, which consist essentially of the recurring monomer units structurally represented hereinabove, can be prepared by the polymerization of isopropenyl ester compounds having the formula:

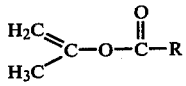

wherein R is a member selected from the group consisting of aliphatic, alicyclic, and aromatic hydrocarbon radicals containing between 1 and about 10 carbon atoms.

Poly(isopropenyl acetate) is prepared by conventional polymerization techniques using commercially available isopropenyl acetate. Certain of the starting isopropenyl ester compounds, which are higher homologs of the acetate ester, can be synthesized using the procedure of Mitsudo et al. (T. Mitsudo, Y. Watanabe, T. Sasaki, H. Nakanishi, M. Yamashita, and Y. Takegami, *Tetrahedron Lett.*, 3163, 1975). Alternatively, the isopropenyl ester is prepared by first reacting a metal hydride, preferably potassium hydride, with acetone in a solvent at 0° C.:

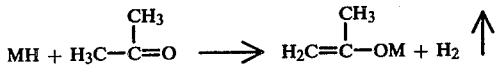

wherein M is alkali metal. In a second step, the acetone enolate so prepared is added dropwise to a cooled solution of an acyl chloride to yield the desired isopropenyl ester:

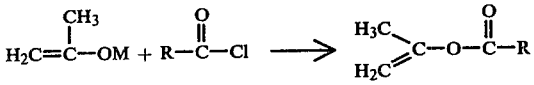

wherein R is as previously defined hereinabove. Suitable solvents include benzene, toluene, dioxane, tetrahydrofuran, dimethylformamide, dimethoxyethane, and the like.

The isopropenyl ester compounds can be converted into the carboxylic acid flavorant-release oligomeric and polymeric compositions of the present invention employing conventional procedures for homopolymerization. The polymerization is normally conducted at a temperature in the range between about 20° and 100° C. under an inert atmosphere in the presence of a free radical generating catalyst. Suitable catalysts include peroxide compounds, such as benzoyl peroxide, cumene hydroperoxide, methyl ethyl ketone peroxide, and the like; azo compounds, such as 2,2'-azobisisobutyronitrile and the like; and other known catalyst systems, such as trialkylboron and oxygen (trace), trialkylaluminum and oxygen (trace), and the like. Typical polymerization accelerators, such as cobalt compounds, sulfur compounds, or amine compounds, may also be employed in conjunction with the polymerization catalyst.

A preferred embodiment for preparing the poly(isopropenyl ester) compounds involves a conventional suspension technique wherein the isopropenyl ester is polymerized in the presence of a suspending agent, such as methyl cellulose, polyvinyl alcohol, dextrin, and the like. Free radical generating catalysts and other polymerization accelerators, such as those mentioned hereinabove, may be incorporated in the reaction mixture.

The present invention carboxylic acid flavorant-release oligomeric and polymeric compositions can vary over a wide range of molecular weight, but preferably the molecular weight is maintained in the range between about 1000 and 5000. This is in contrast to the more commonly used vinyl esters, which, on polymerization, characteristically yield high molecular weight polymers that would preclude ethanol solubility.

Generally, the number of recurring monomeric units will vary between about 2 and about 200. For application as carboxylic acid flavorant-release agents in tobacco compositions, it is preferred that the average number of recurring monomeric units in the polymeric compositions be maintained in the range between about 5 and 50 so as to insure their solubility in ethanol.

Smoking Tobacco Composition

In an important embodiment, the present invention provides a smoking composition that comprises an admixture of natural or reconstituted tobacco or a non-tobacco smoking substitute and between about 0.001 and 1.0 weight percent, based on the weight of tobacco, of a carboxylic acid flavorant-release agent that corresponds to the structural formula set forth hereinabove in definition of the present invention polymers of isopropenyl esters.

The invention carboxylic acid flavorant-release poly(isopropenyl ester) composition can be incorporated into the tobacco in accordance with methods known and used in the art. In a preferred embodiment, the carboxylic acid flavorant-release agent is dissolved in a solvent, such as ethanol, and then sprayed or injected into the tobacco matrix. Such method insures an even distribution of the flavorant-release agent throughout the tobacco and thereby facilitates the production of a more uniform smoking tobacco composition.

In an alternate method of incorporation into tobacco, the carboxylic acid flavorant-release poly(isopropenyl ester) composition can be admixed in solid form with the components of a reconstituted sheet of tobacco prior to the forming of the sheet.

In accordance with this invention, there is substantially no loss of carboxylic acid flavorant through sublimation or volatilization thereof during the manufacturing and storage operations incident to the production of a useful smoking composition. Additionally, the drawbacks of diffusion of a flavorant, such as the carboxylic acids, within the tobacco are successfully eliminated, and the control of quality and uniformity within the product tobacco compositions is successfully maintained.

The following examples are further illustrative of the present invention. The reactants and other specific ingredients are presented as being typical, and various modifications can be derived in view of the foregoing disclosure within the scope of the invention.

EXAMPLE 1

Poly(isopropenyl acetate)

A mixture of 300 g of freshly distilled isopropenyl acetate and 15 g of benzoyl peroxide was placed in a flask and purged with nitrogen for 30 minutes. The flask was placed in an 80° C. oil bath and stirred at that temperature for 43 hours. The reaction mixture was placed on a rotary evaporator with a bath temperature of 65° C. to remove the majority of the unreacted isopropenyl acetate. The residue was cooled to room temperature and 300 ml of dry methanol was added. The methanol-product mixture was heated until the product was completely dissolved. The solution was then slowly added to a Waring Blendor containing a slurry of water and ice. The precipitated polymer was washed with one liter of cold water, air dried initially, and then dried in a vacuum oven at 60° C. The polymer was powdered and dried under high vacuum overnight. The yield of dry polymer was 108 g (35%).

EXAMPLE 2

Poly(isopropenyl acetate)

To a 500 ml three-necked flask was added 100 g of isopropenyl acetate in 100 ml of a 1% aqueous solution of methyl cellulose (1500 cp). To the suspension was added 6 g of benzoyl peroxide. The flask was placed in an oil bath at 60° C., and the suspension was stirred with a high torque overhead stirrer. The temperature of the oil bath was raised to 80° C. over a 17-minute period, and the polymerization was allowed to continue at this temperature 24 hours. The contents of the flask were allowed to cool. The polymer was worked up by removing the water and unreacted monomer under high vacuum (0.05 mm) for 48 hours. The final yield of polymer was 60%. Molecular weight measurements show a molecular weight of approximately 1000(n=10).

| $^{13}$C-nmr Spectrum of Poly (Isopropenyl Acetate) | |
|---|---|
| Carbon Position | Chemical Shift |
| $-CH_2-$ | 46.5 ppm |
| $-\overset{\vert}{\underset{\vert}{C}}-O$ | 84.5 ppm |
| $-CH_3$ (on polymeric chain) | 34.5 ppm |
| $-CH_3$ (acetate) | 22.9 ppm |
| $-\underset{\underset{O}{\Vert}}{C}-O-$ | 169.9 ppm |

| I.R. | |
|---|---|
| Structural Component | Frequency |
| Ester carbonyl | 1732 cm$^{-1}$ |
| Ester ether | 1250 cm$^{-1}$ |
| $CH_3-\underset{\underset{O}{\Vert}}{C}-O$ | 1370 cm$^{-1}$ |

-continued

EXAMPLE 3

Poly(isopropenyl isobutyrate)

Isopropenyl isobutyrate was prepared by the potassium hydride catalyzed condensation of acetone with isobutyryl chloride as follows. A suspension of potassium hydride (100 g, 2.5 mol.) in 1.5 liters of dry tetrahydrofuran was prepared. The suspension was cooled to −10° C. and 200 ml acetone was slowly added maintaining the temperature of the reaction mixture between 0° and −10° C. The resulting solution of acetone enolate was added to a solution of 266 g (2.5 mol.) of isobutyryl chloride in 3 liters of tetrahydrofuran over a 30-minute period. The temperature of the reaction flask was maintained between −30° and −50° C. during the addition. After 16 hours the reaction mixture was poured into water and the resulting mixture was extracted with ether. The ether extracts were combined, dried over sodium sulfate, and the solvent was removed. The residue was distilled through a thin film evaporator (114° to 125° C.) and the distillate was redistilled through a spinning band column. The fraction boiling at 40° to 46° C. (1.5 mm Hg) was collected to give a total of 21 g (7%) of pure isopropenyl isobutyrate. The isopropenyl isobutyrate was polymerized according to the method described in Example 2 to give the corresponding polymer.

EXAMPLE 4

Poly(isopropenyl propionate)

Isopropenyl propionate, prepared according to the method described in Example 3, is polymerized according to the method described in Example 2.

EXAMPLE 5

Poly(isopropenyl butyrate)

Isopropenyl butyrate, prepared according to the method described in Example 3, is polymerized according to the method described in Example 2.

EXAMPLE 6

Poly(isopropenyl isovalerate)

Isopropenyl isovalerate, prepared by the method of Mitsudo et al., (T. Mitsudo, Y. Watanabe, T. Sasaki, H. Nakanishi, M. Yamashita, and Y. Takegami, *Tetrahedron Lett.*, 3163, 1975) is polymerized according to the method described in Example 2.

EXAMPLE 7

Poly(isopropenyl 3-methylvalerate)

Isopropenyl 3-methylvalerate, prepared according to the method described in Example 3, is polymerized according to the method described in Example 2.

EXAMPLE 8

Poly(isopropenyl cyclohexanecarboxylate)

Isopropenyl cyclohexanecarboxylate, prepared according to the method of Mitsudo et al., is polymerized according to the method described in Example 2.

EXAMPLE 9

Poly(isopropenyl 4-methylbenzoate).

Isopropenyl 4-methylbenzoate, prepared according to the method of Mitsudo et al. is polymerized according to the method described in Example 2.

EXAMPLE 10

A sample of 8.5 g of poly(isopropenyl acetate), prepared in Example 2 wherein n=10, was dissolved in 90 ml ethanol, and 40 ml of water was added. The resulting solution was sprayed on 10 lbs. of filler to give a final concentration of about 0.2% by weight of the tobacco. The treated filler was allowed to dry, and cigarettes were fabricated using both treated and untreated filler (control). The cigarettes were equipped with conventional cellulose acetate filters and were designed to deliver approximately 5 to 6 mg TPM (tar). The control and treated cigarettes were smoked by a panel of experienced smokers who found that the treated cigarettes had significantly higher impact and flavor than the untreated controls.

The experimental cigarettes, which had been treated with poly(isopropenyl acetate), and the untreated controls were smoked under identical conditions, alternating test and control cigarettes. A standard gas phase collection smoking machine additionally equipped to trap sidestream smoke was used. Cigarettes were smoked according to standard conditions on a five-port smoking machine (35 ml puff every 60 seconds, 2-second duration) in a controlled atmosphere.

Acetic acid in the mainstream was analyzed using standard chromatography techniques. The results are tabulated in Table I.

Table 1

| ACETIC ACID DELIVERED | |
|---|---|
| Cigarette | Mainstream (mg/cig.) |
| Experimental | 0.264 |
| | 0.274 |
| | 0.236 |
| | 0.261 |
| | 0.261 |
| Control | 0.194 |
| | 0.190 |
| | 0.250 |
| | 0.194 |
| | 0.210 |

The experimental cigarettes containing poly(isopropenyl acetate) were found to deliver about 25% more acetic acid on smoking than the control cigarettes having identical configurations and filters.

EXAMPLE 11

Poly(isopropenyl 3-methylvalerate) is added to smoking tobacco in accordance with Example 10 with the exception that the amount of polymer added is 0.5% by weight of the tobacco. Cigarettes may then be made from this treated tobacco; and upon smoking, 3-methylvaleric acid is observed in the cigarette smoke.

EXAMPLE 12

Poly(isopropenyl 4-methylbenzoate) is added to smoking tobacco in accordance with Example 10 to give a final concentration of about 0.001% of polymer by weight of the tobacco. Cigarettes may then be made from the treated tobacco; and upon smoking, 4-methylbenzoic acid is observed in the smoke of the cigarette.

EXAMPLE 13

Poly(isopropenyl butyrate) is dissolved in ethanol and sprayed on a reconstituted tobacco sheet to give a final concentration of about 5% polymer by weight of the sheet. The sheet is shredded and mixed with a conventional blend of smoking tobaccos. The final blend contains about 20% reconstituted tobacco and approximately 1.0% poly(isopropenylbutyrate). Cigarettes are fabricated using the prepared blend, and on smoking butyric acid is observed in the smoke.

EXAMPLE 14

Poly(isopropenyl acetate) prepared in Example 2 is dissolved in ethanol and sprayed on a sheet of a tobacco substitute smoking material such as one disclosed by Rainer et al. in U.S. Pat. No. 4,034,764 to give a final concentration of 0.25% polymer by weight of the substitute material. Cigarettes are fabricated using the substitute material, and on smoking, acetic acid is observed in the mainstream smoke.

While this invention is particularly useful in the manufacture of cigarette tobacco, it is also suitable for use in connection with the manufacture of pipe tobacco, cigars, and other tobacco products formed from sheeted tobacco dust or fines, which are well known to the art. Furthermore, the additive compounds may be added to certain other smoking compositions such as tobacco substitutes of natural or synthetic origin. By the term "tobacco" as used throughout this specification is meant any composition composed of tobacco plant parts or substitute materials or both.

Those modifications and equivalents that fall within the spirit of the invention and the scope of the appended claims are to be considered part of the invention.

What is claimed is:

1. A smoking composition having incorporated therein from a small but effective amount up to about 1.0% based on the weight of the composition of a carboxylic acid flavorant-release poly(isopropenyl ester) having the formula:

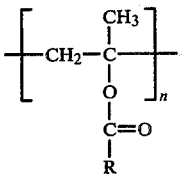

wherein R is a member selected from the group consisting of aliphatic, alicyclic, and aromatic hydrocarbon radicals containing between 1 and about 10 carbon atoms and n is an integer between 2 and about 200.

2. The composition of claim 1 wherein n is an integer between about 5 and 50.

3. The composition of claim 1 wherein R is a member selected from the group consisting of aliphatic radicals containing between 1 and 6 carbon atoms.

4. The composition of claim 3 wherein R is methyl.

5. The composition of claim 3 wherein R is ethyl.

6. The composition in accordance with claim 3 wherein R is propyl.

7. The composition in accordance with claim 3 wherein R is isopropyl.

8. The composition in accordance with claim 3 wherein R is isobutyl.

9. The composition in accordance with claim 3 wherein R is butyl.

10. The composition in accordance with claim 3 wherein R is pentyl.

11. The composition of claim 1 comprising an admixture of natural tobacco materials.

12. The composition of claim 1 comprising a non-tobacco substitute material.

13. The composition of claim 1 comprising an admixture of natural and reconstituted tobacco.

* * * * *